US007028592B2

(12) United States Patent
Hills

(10) Patent No.: US 7,028,592 B2
(45) Date of Patent: Apr. 18, 2006

(54) TOOL ELEMENT AND SCREW FOR MATING ENGAGEMENT THEREWITH

(76) Inventor: Jeffrey M. Hills, P.O. Box 1571, El Prado, NM (US) 87529

( * ) Notice: Subject to any disclaimer, the term of this patent is extended or adjusted under 35 U.S.C. 154(b) by 0 days.

(21) Appl. No.: 10/879,874

(22) Filed: Jun. 28, 2004

(65) Prior Publication Data

US 2005/0178250 A1 Aug. 18, 2005

Related U.S. Application Data

(60) Provisional application No. 60/545,517, filed on Feb. 17, 2004.

(51) Int. Cl.
*B25B 15/00* (2006.01)

(52) U.S. Cl. ..... 81/436; 81/461

(58) Field of Classification Search ..... 81/436, 81/460, 461; 411/402–410, 919
See application file for complete search history.

(56) References Cited

U.S. PATENT DOCUMENTS 1,797,390 A * 3/1931 Launay ..... 81/436
2,567,466 A * 9/1951 Bartlett ..... 81/436
3,175,593 A * 3/1965 Pierre ..... 81/436
3,888,144 A * 6/1975 Parsons ..... 81/436
3,891,017 A * 6/1975 Iskra ..... 81/436
3,985,170 A * 10/1976 Iskra ..... 81/438
4,190,091 A * 2/1980 Colognori ..... 81/453
4,325,153 A * 4/1982 Finnegan ..... 7/165
5,214,987 A * 6/1993 Fenton, Sr. ..... 81/460
6,128,983 A * 10/2000 Arnn ..... 81/460

* cited by examiner

*Primary Examiner*—David B. Thomas
(74) *Attorney, Agent, or Firm*—Chernow Katz LLC; Andrew B. Katz, Esq.

(57) ABSTRACT

Disclosed herein is a kit comprising a tool element and a screw for mating engagement therewith. The tool element is preferably a portion of a screwdriver, ratchet or power tool and preferably comprises blade means, flared drive means and substantially rectangular shank drive means. The screw preferably comprises a head and a body and the head of the screw preferably comprises a slot and a substantially rectangular shank set. In preferred embodiments of the kit, the flared drive means of the tool element is preferably sized to engage the slot of the screw and the substantially rectangular shank drive means of the tool element is preferably sized to engage the substantially rectangular shank set of the screw. Additional embodiments of the invention are disclosed herein.

31 Claims, 6 Drawing Sheets

TOOL ELEMENT AND SCREW FOR MATING ENGAGEMENT THEREWITH

CROSS-REFERENCE TO RELATED APPLICATIONS

The present application claims the benefit under 35 U.S.C. §119(e) of U.S. Application No. 60/545,517, filed Feb. 17, 2004, which is hereby incorporated by reference in its entirety for all purposes.

BACKGROUND OF THE INVENTION

The invention disclosed herein relates generally to a kit comprising a tool element and screw. More specifically, preferred embodiments of the disclosed invention relate to a tool element for facilitating driving of a screw and a screwdriver, ratchet or power tool comprising the tool element. Preferred embodiments of the kit also include a screw for mating engagement with the tool element. Additional embodiments of the invention are also contemplated and disclosed.

Screws are one of the most widely used fastener devices and can be used for wood applications, machine applications and other uses. Varying embodiments of screws have flat heads, oval head, pan heads or round head. Traditional screwdriver systems comprise slotted drivers, Phillips drivers, square drivers, allen drivers and tormex drivers and are driven with fully-manually actionable drive means, ratchet drive means or electrically powered drive means (e.g. a power drill). Unfortunately, the slots in these screws provide a difficult base to keep the driver stable, resulting in slippage and resulting screw head damage. Power drivers have traditionally had even more instability, due to their higher rotational forces. Often this slippage, which causes inefficiency in task completion, also causes cosmetic damage to the screw, especially in solid brass fine woodworking, and screws for hardware.

Attempts have been made to improve on conventional screw and driver design, however such attempts have failed to account for a multitude of important factors. For example, U.S. Pat. No. 3,891,017 ("Iskra") shows a square drive, but Iskra is a design that requires a unique screw that will not have compatibility with conventional screwdrivers and other conventional tool elements. For example, the torque provided by the driver in Iskra is minimal due to its use of a square driver.

There is a need for a relatively low cost screwdriver and/or screw system that will permit the user to apply only rotational force and simultaneously reliably retain contact between the driver and the screw head. Overcoming the disadvantages present in the prior art, preferred embodiments of the invention disclosed herein utilizes unique drive structures to increase needed torque and decrease harmful slippage.

SUMMARY OF THE INVENTION

Disclosed herein is a kit comprising a tool element and a screw. The tool element is preferably a portion of a screwdriver, ratchet or power tool and preferably comprises blade means, flared drive means and substantially rectangular shank drive means. The screw preferably comprises a head and a body.

In preferred embodiments of the kit, the flared drive means is preferably fixed to the blade means and comprises a flared drive means front surface and a flared drive means rear surface. The substantially rectangular shank drive means is preferably fixed to the flared drive means, and preferably comprises a shank drive means front surface and a shank drive means rear surface. The shank drive means front surface is preferably coplanar with the flared drive means front surface, and the shank drive means rear surface is preferably coplanar with the flared drive means rear surface.

In preferred embodiments of the kit, the head of the screw preferably comprises a slot aligned along an axis running across a diameter of the head, where the slot preferably has a slot front inner surface and a slot rear inner surface. The head of the screw preferably further comprises a substantially rectangular shank set formed below the slot that is aligned along the axis. The substantially rectangular shank set preferably include both a shank set front inner surface coplanar with the slot front inner surface, as well as a shank set rear inner surface coplanar with the slot rear inner surface. In preferred embodiments, the screw preferably comprises a wood screw.

In preferred embodiments of the kit, the flared drive means of the tool element is preferably sized to engage the slot of the screw. Also, the substantially rectangular shank drive means is preferably sized to engage the substantially rectangular shank set of the screw. In preferred embodiments, there is thus a substantially mating engagement between the tool element and the screw for increased torque and reduced slippage. The tool element is preferably a portion of a screwdriver or other tool, to facilitate easier driving of the screw.

Also disclosed herein are embodiments of a tool element for facilitating driving of a screw. The tool element preferably comprises a blade, a flared drive and a substantially rectangular shank drive, which are preferably of one-piece construction. The blade preferably comprises a blade front surface, a blade rear surface, a blade left surface and a blade right surface. A top end of the flared drive is preferably fixed to the bottom end of the blade.

The flared drive preferably comprises a flared drive bottom end, a flared drive front surface and a flared drive rear surface. The flared drive front surface is preferably coplanar with the blade front surface and preferably extends from the blade front surface to the flared drive bottom end. The flared drive rear surface is preferably coplanar with the blade rear surface and preferably extends from the blade rear surface to the flared drive bottom end. The flared drive rear surface is preferably parallel with the flared drive front surface. The flared drive preferably comprises a flared drive left surface that outwardly extends from the blade left surface to the flared drive bottom end to form a first angle and a flared drive right surface that outwardly extends from the blade right surface to the flared drive bottom end to form a second angle. In preferred embodiments, the first angle is substantially equal to the second angle and two acute angles are formed with respect to the flared drive bottom end.

The flared drive bottom end is preferably fixed to a top end of the substantially rectangular shank drive, which preferably includes a shank drive bottom surface, a shank drive left surface and a shank drive right surface, which is preferably parallel to the shank drive left surface. The substantially rectangular shank drive preferably also includes a shank drive front surface and a shank drive rear surface, where the shank drive front surface is preferably coplanar with the flared drive front surface and where the shank drive rear surface is preferably coplanar with the flared drive rear surface. The shank drive rear surface is preferably parallel to the shank drive front surface.

In preferred embodiments, the width of the shank drive front surface is less than the width of the flared drive front surface at the flared drive bottom end. In some aspects, the width of the shank drive front surface is greater than the width of the shank drive right surface. Generally, the wider the shank drive the greater the surface area of retention for power tool driver. A wider shank drive has is more efficient, has greater torque, and greater leverage occurring in the screw. The substantially rectangular shank drive and the wide flared drive translate stronger driving and rotational forces deeper into the screw.

In preferred embodiments, the shank drive front surface, shank drive rear surface, shank drive left surface, shank drive right surface and the shank drive bottom surface form substantially ninety-degree corners with one another. In some embodiments, radial corners are formed.

Also disclosed herein is a screwdriver that includes the tool element. In preferred embodiments, the screwdriver includes a handle and a shank connecting the handle to the blade of the tool element. In preferred embodiments, the shank, the blade, the flared drive and the substantially rectangular shank drive form a one-piece structure. In some embodiments, a ratchet comprises the tool element.

In some embodiments of the invention, a tool bit comprises the tool element and an electrically-powered tool may comprise the tool bit. The electrically powered tool preferably included electrically powered drive means and a handle for positioning the electrically powered tool. A shaft connects the electrically powered drive means to the tool bit and the shaft is axially rotatable by the electrically powered drive means.

Also disclosed herein are embodiments of a tool element for facilitating driving of a screw that includes blade means and flared drive means. The flared drive means are fixed to the blade means and the flared drive means preferably include a flared drive means front surface and a flared drive means rear surface. The tool element preferably also includes a substantially rectangular shank drive means that is fixed to the flared drive means and includes a shank drive means front surface and shank drive means rear surface. The shank drive means front surface is preferably coplanar with the flared drive means front surface and the shank drive means rear surface is preferably coplanar with the flared drive means rear surface. Also disclosed herein are embodiments of a screw for mating engagement with the tool element.

Also disclosed herein are embodiments of a screw having a body and a head, where the head preferably includes a slot and a substantially rectangular shank set. The slot is preferably aligned along an axis of a diameter of the head and includes a slot front inner surface and a slot rear inner surface. Below the slot is preferably a substantially rectangular shank set also aligned along the axis. The shank set preferably includes a shank set front inner surface coplanar with the slot front inner surface, as well as a shank set rear inner surface coplanar with the slot rear inner surface. In some embodiments, the screw further includes a left band of material to the left of the slot and a right band of material to the right of the slot.

These and other features and objects of the invention will be more fully understood from the following detailed description of the preferred embodiments, which should be read in light of the accompanying drawings.

BRIEF DESCRIPTION OF THE DRAWINGS

The accompanying drawings, which are incorporated in and form a part of the specification, illustrate the embodiments of the present invention and, together with the description serve to explain the principles of the invention. In the drawings.

DETAILED DESCRIPTION OF THE INVENTION

Figure 1:
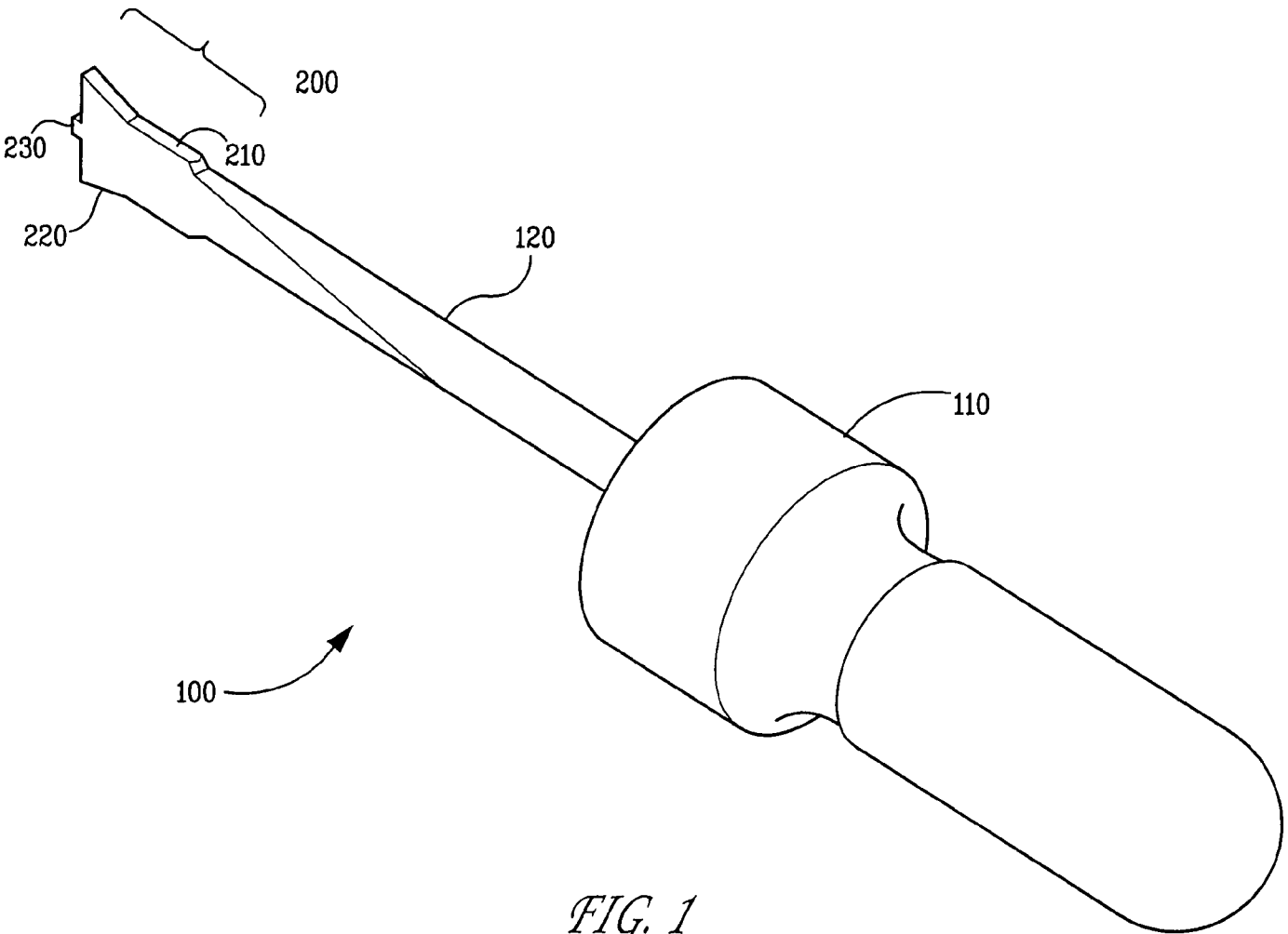
FIG. 1 is a perspective view showing an embodiment of a screwdriver comprising a tool element.

In describing a preferred embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

Preferred embodiments of the invention relate to an improved screw and driver system that embodies an efficient use of driver force, where the screw and the tool element can be passively locked into position, utilizing the screw head design and screwdriver system. The increased efficiency is realized in both screw insertion and screw removal and preferred embodiments of the screw allow for the alternating use of the tool element and a conventional flathead screwdriver should the need arise. In fact, the screw of the present invention is preferably engineered to mate perfectly both with the tool element and a conventional screwdriver, drill bit, etc. For example a number-eight screw of the present invention would precisely fit all number-eight screwdrivers.

The screw thus experiences increased driving torque with significant holding and retentive properties, while the screw still maintains the favored appearance of a traditional slotted screw. The tool element can drive deeply into the screw via the shank set and has increased moment arm, leverage and torque in the part of the screw with the greatest mass. This will not only enhance screw placement, but also screw removal as well, especially stubborn older screws.

Both the screw and the tool element can be economically produced using conventional high-speed equipment. The preferred tool element will work on wood screws, sheet metal and machine screws over a variety of head designs, flat, pan, oval and round. The tool element will also work via hand, ratchet or power-driven means, magnetized or non-magnetized, and with or without a supportive shroud. The tool element will also retain a screw in its dual-driver system and help position the screw in difficult-to-reach places.

It is a feature of preferred embodiments of the present invention that the screw has both a conventional slot (or other slot) and a central rectangular intrusion into which a male shank drive mates. The two engaging surfaces provide a stable base for the application of rotational forces. Furthermore, the tool element's flared sides also increase torque due to the extension from a central fulcrum pivot point at the blade. Although one primary objective is to increase stability and efficiency when driving screws, another objective is the preservation of the integrity and cosmetics of fine woodworking screws.

With principal reference to FIG. 1, a screwdriver is shown and designated generally 100. The screwdriver comprises a handle 110, a tool element 200, and a shank 120 connecting handle 110 to tool element 200. Shank 120 is preferably rectangular and is either releasably connected or permanently mounted to handle 110 for manual use. Although tool element 200 is shown as an integrated part of screwdriver 100, tool element 200 may also be a stand-alone structure. In some embodiments, tool element 200 may be a constituent part of a tool bit (not shown). Tool bits are well known in the art and tool element 200 may be adapted to function as a tool bit. For example, shank 120 and/or blade 210 may be operatively engaged by a chuck or other similar devices, such as that shown in FIG. 10, for example.

Figures 2, 3, 4:
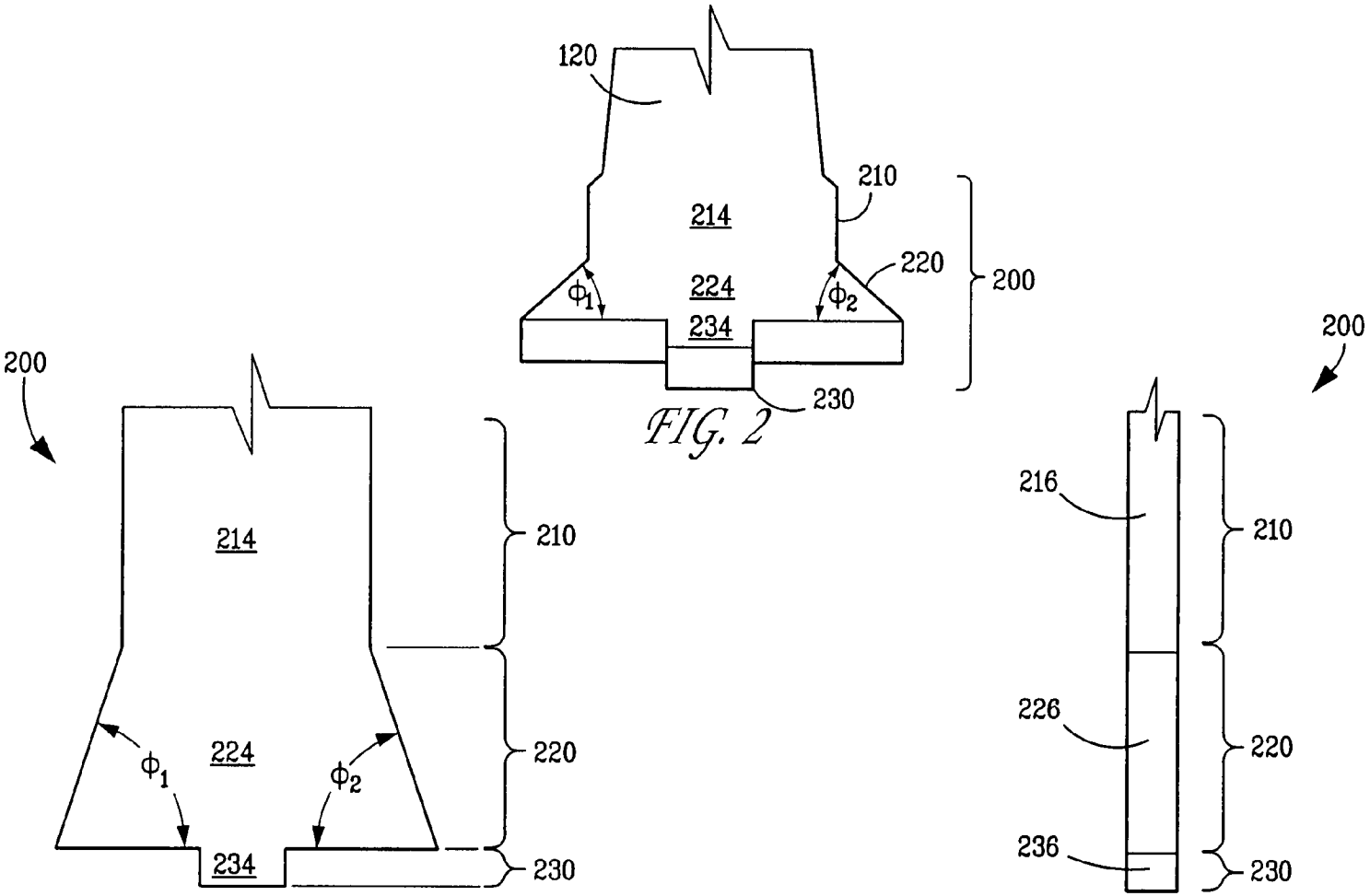
FIG. 2 is a perspective view showing an embodiment of a tool element.
FIG. 3 is a front view showing the embodiment of the tool element shown in FIG. 2, the rear view being a mirror image thereof.
FIG. 4 is right-side view showing the embodiment of the tool element shown in FIG. 2, the left-side view being a mirror image thereof.

With principal reference to FIGS. 2 through 4, a preferred embodiment of tool element 200 is shown. Tool element 200 is shown to include blade 210, flared drive 220 and shank drive 230, the preferred embodiment of which will now be described.

Blade 210 is a preferred embodiment of "blade means," although additional embodiments of blade 210 are contemplated, the bottom portion of blade 210 is preferably flat on both sides outwards toward the center. Opposing sides of blade 210 are preferably parallel to one another and blade 210 is preferably smooth on both side. Blade 210 preferably includes a blade front surface 214, a blade rear surface, a blade right surface 216 and a blade left surface. The blade rear surface and the blade left surface are not shown in the drawings, but need not be shown due to the preferred symmetry of blade 210.

Flared drive 220 is preferably attached to a bottom end of blade 210 at a bottom end of flared drive 220. While additional embodiments of flared drive 220 are contemplated, flared drive 220 is a preferred embodiment of "flared drive means." Flared drive 220 preferably includes a flared drive front side surface 224 and a flared drive rear side surface. Flared drive rear surface and flared drive left surface are not shown in the drawings, but need not be shown due to the preferred symmetry of flared drive 220. Flared drive front surface 224 and flared drive rear surface are preferably parallel with one another. Furthermore, flared drive front surface 224 is coplanar with blade front surface 214, and the flared drive rear surface is preferably coplanar with the blade rear surface. Both the flared drive rear surface and flared drive front surface 224 extend to the bottom end of flared drive 220.

Continuing with principal reference to FIGS. 2 through 4, flared drive 220 preferably also includes a flared drive right surface 226 and a flared drive left side surface. Each of flared drive right surface 226 and flared drive left surface preferably outwardly extend from blade right surface 216 and blade left surface, respectively, to the flared drive bottom end, thereby preferably creating a trapezoidal appearance of flared drive 220 (from a front view). Flared drive left surface and flared drive right surface 226 each meet the bottom end creating a first internal angle $\theta_1$ and a second internal angle $\theta_2$, respectively. From the front view, these angles would appear as the lower two inner angles of a trapezoid. First internal angle $\theta_1$ and second internal angle $\theta_2$, are preferably equal to one another. Furthermore, first internal angle $\theta_1$ and second internal angle $\theta_2$, are preferably acute angles and, more preferably, are acute angles of approximately eighty-two degrees each. Flared drive left surface is not shown in the figures, it need not be shown due to the preferred symmetry flared drive 220.

Continuing with principal reference to FIGS. 2 through 4, tool element 200 also includes a substantially rectangular shank drive 230. A top end of substantially rectangular shank drive 230 is preferably fixed to the bottom end of flared drive 220. While additional embodiments of substantially rectangular shank drive 230 are contemplated, substantially rectangular shank drive 230 is a preferred embodiment of "substantially rectangular shank drive means." Substantially rectangular shank drive 230 preferably comprises a shank drive front surface 234 and a shank drive rear surface that is a mirror image thereof. Substantially rectangular shank drive 230 preferably comprises a shank drive right surface 236 and a shank drive left surface that is a mirror image thereof. Substantially rectangular shank drive also comprises a bottom surface. Not all shank drive surfaces are shown in the figures, but they need not be shown due to the preferred symmetry of substantially rectangular shank drive 230.

Shank drive right surface 236 is preferably parallel with the shank drive left surface 236. Moreover, shank drive front surface 234 is preferably coplanar with flared drive front surface 224, while the shank drive rear surface is preferably coplanar with the flared drive rear surface. The width of shank drive front surface 234 is preferably less than a width of flared drive front surface 224 at the flared drive bottom end, thus creating the protrusion in preferred embodiments. Furthermore, the width of shank drive front surface 234 is greater than a width of shank drive right surface 236, thereby creating a longer moment arm for facilitating higher rotational forces. Substantially rectangular shank drive 230 preferably comprises a parallelogram shape all of whose angles are right angles (or radial corners) and more preferably has adjacent sides of unequal length.

Figure 5:
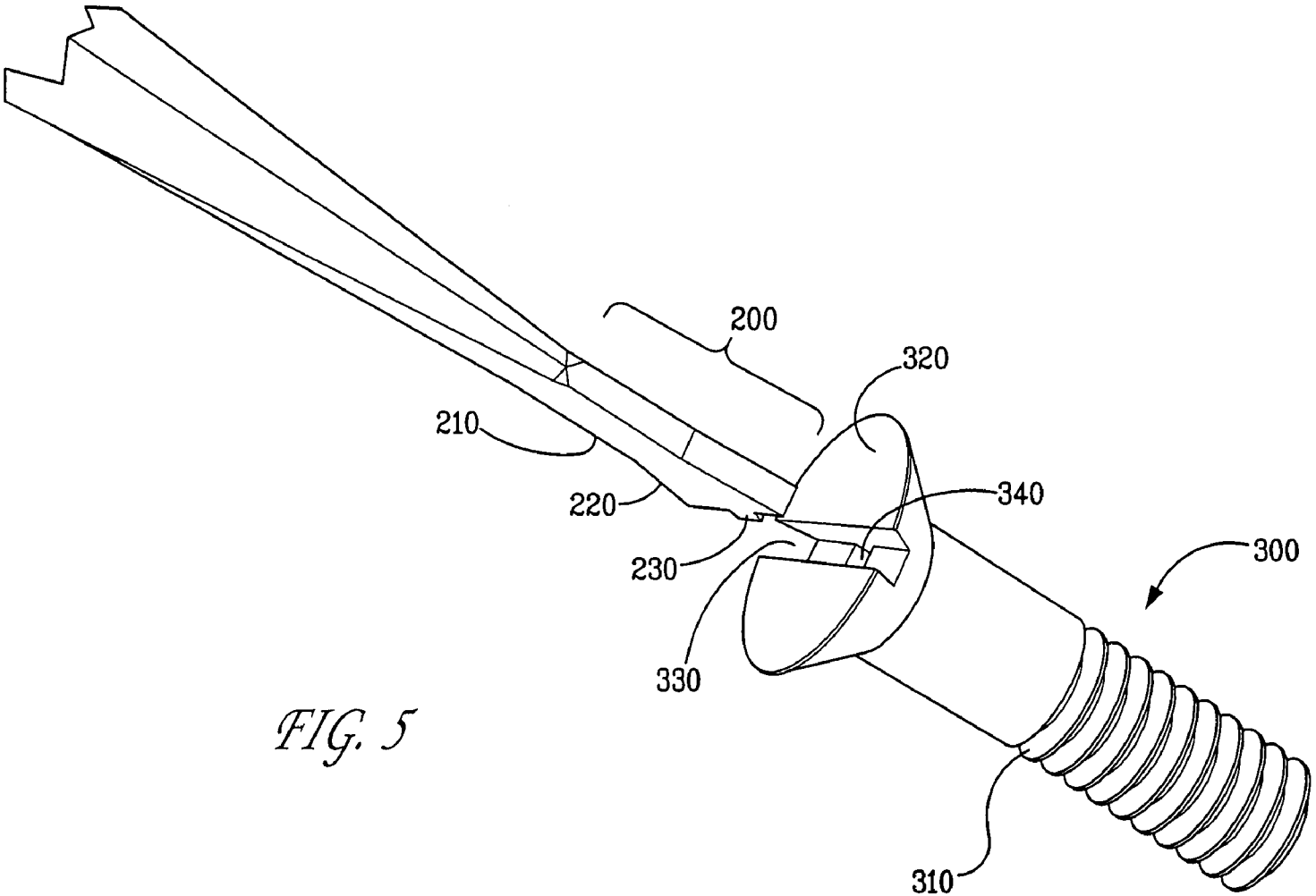
FIG. 5 is a perspective view showing an embodiment of a tool element and screw.
Figure 7:
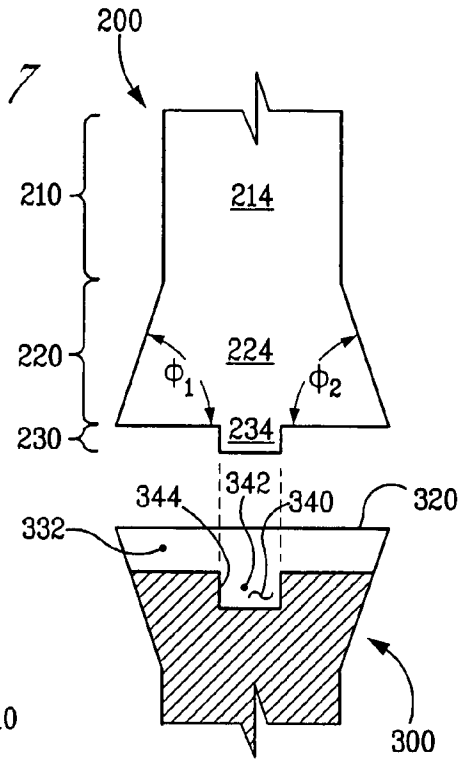
FIG. 7 is a partially sectional front view showing the embodiment of the tool element and screw shown in FIG. 5.
Figure 6:
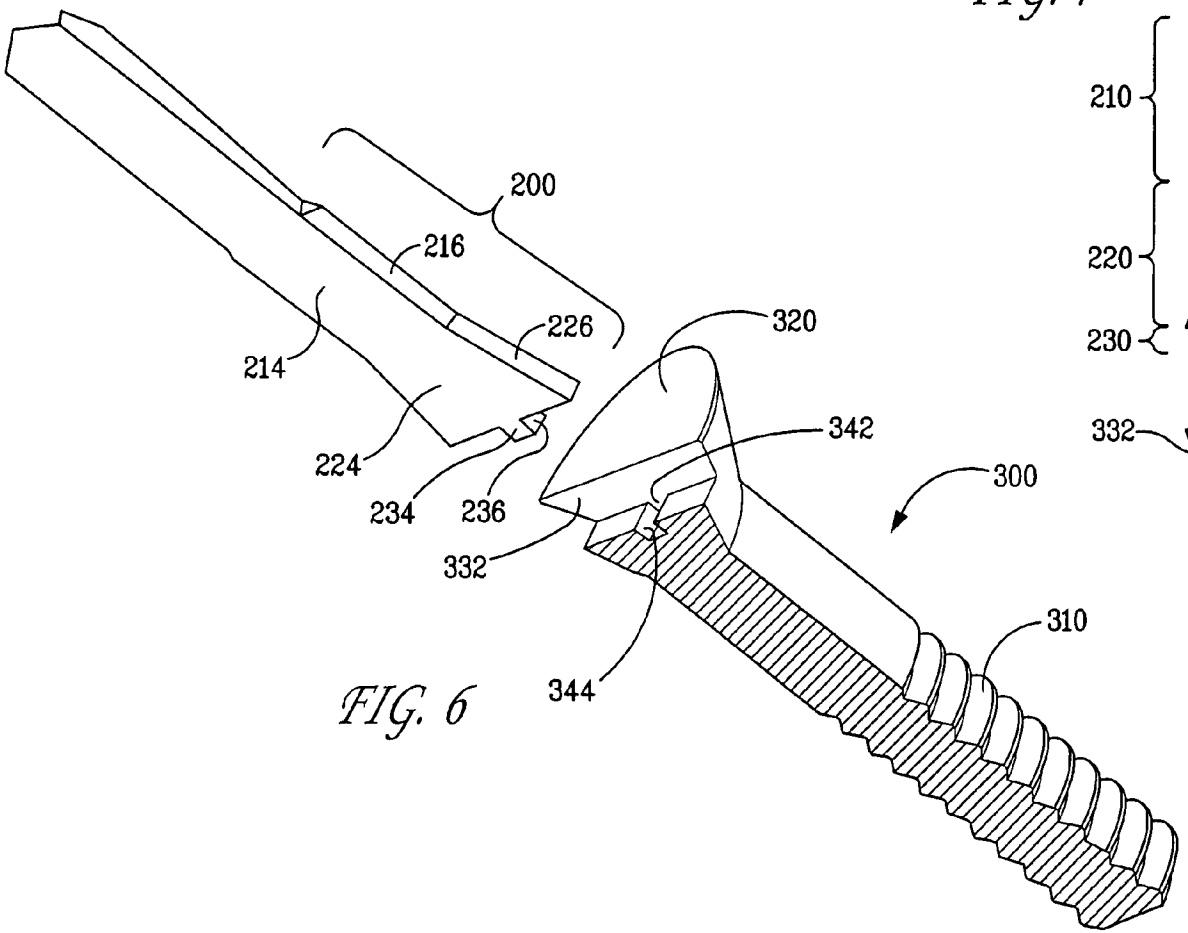
FIG. 6 is a partially-sectional perspective view showing the embodiment of the tool element and screw shown in FIG. 5.

With principal reference to FIGS. 5 through 7, a preferred screw is shown and designated generally as 300. Tool element 200 is shown to work together with screw 300 to efficiently and effectively drive and set screws. Substantially rectangular shank drive 230 at least in part enables screw 310 to be carried by tool element 200 to be held there at any desired angle, for true and accurate driving, while eliminating any head damage due to slippage. Screw 300 preferably comprises body 310 and head 320. Screw 300 is shown to be a wood screw, however any suitable screw may be used, with any suitable body 310 and any suitable head 320 (e.g. pan screws, oval head screws, machine screws, round head screws, etc.).

Head 320 of screw 300 comprises slot 330 and shank set 340 for passive engagement with tool element 200. Preferred embodiments of slot 330 are aligned along an axis aligned with a diameter of head 320 and comprise a slot front inner surface and a slot rear inner surface 332. Slot front inner surface is not shown in the drawings, however there is preferably symmetry along the axis of slot 330 and thus the slot front surface need not be shown, being a mirror image of rear inner surface 332.

Head 320 of screw 300 also comprises shank set 340. Preferred embodiments of shank set 340 comprise a central axial rectangular bore that is aligned along the same axis as slot 330. Shank set 340 preferably includes a shank set rear inner surface 342 that is preferably coplanar with slot rear inner surface 332. Shank set 340 preferably also includes a shank set front inner surface that is coplanar with the slot front inner surface, which need not shown due to the preferred symmetry and being a mirror image of slot rear inner surface. Shank set 340 preferably also includes shank set left inner surface 344 and shank set right inner surface. The shank set front inner surface and shank set right inner surface is not shown in the figures, but they need not be shown due to the preferred symmetry of shank set 340.

The female impression of shank set 340 is preferably sized to mate and/or passively engage with substantially rectangular shank drive 230. The width of shank set shank set (about shank set rear inner surface 342 and the shank set front inner surface) is preferably about one-third the width of slot 330 (about slot rear inner surface 332 and lost front inner surface). The depth of shank set 340 is preferably about two to three times greater than the depth of slot 330.

Figure 9:
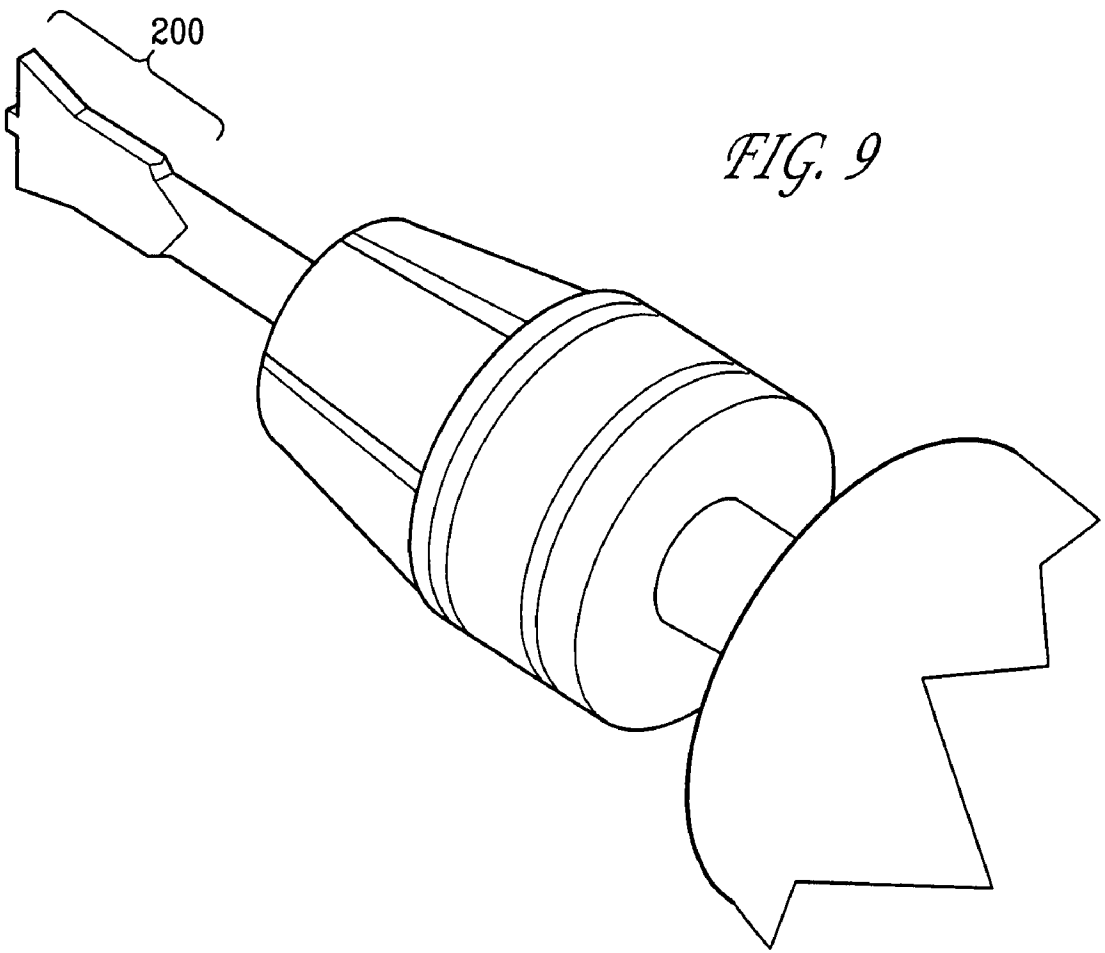
FIG. 9 is a perspective view showing an embodiment of a power tool comprising an embodiment of a tool element.
Figure 8:
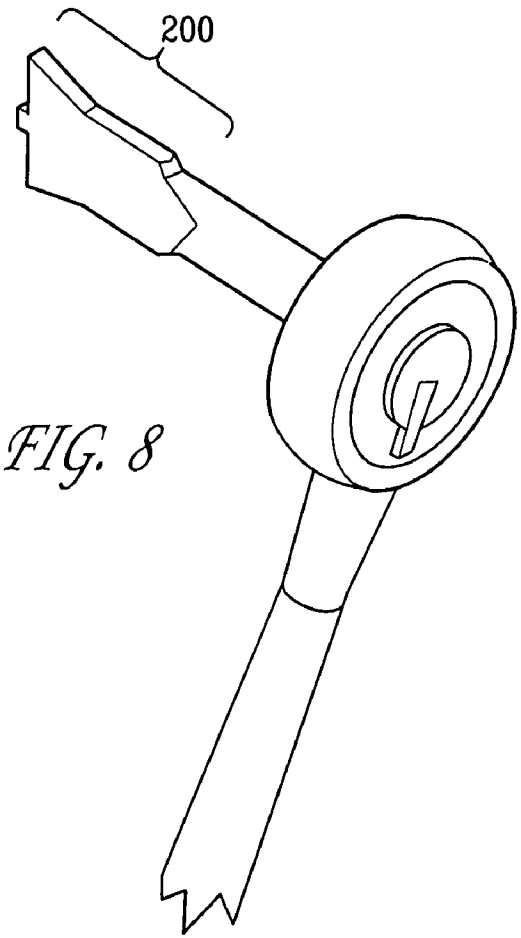
FIG. 8 is a perspective view showing an embodiment of a ratchet comprising an embodiment of a tool element.

With principal reference to FIGS. 1, 8 and 9, tool element 300 may be part of screwdriver 100, a ratchet, a tool bit, an electrically powered tool, or other suitable tool. Screw 300 will also work with conventional driver if necessary. To turn screw 300, tool element 200 is placed with flared drive 220 and substantially rectangular shank drive 230 centered on slot 330 with an interdigitation of the protrusion and intrusion. Rotation of tool element 200 is then initiated by actuating the driving mechanism, whether it be a screwdriver, ratchet or power tool.

Figure 11:
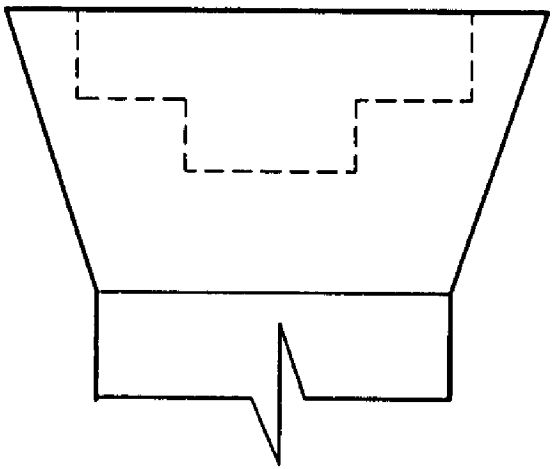
FIG. 11 is a side view showing the embodiment of the screw head shown in FIG. 10.
Figure 10:
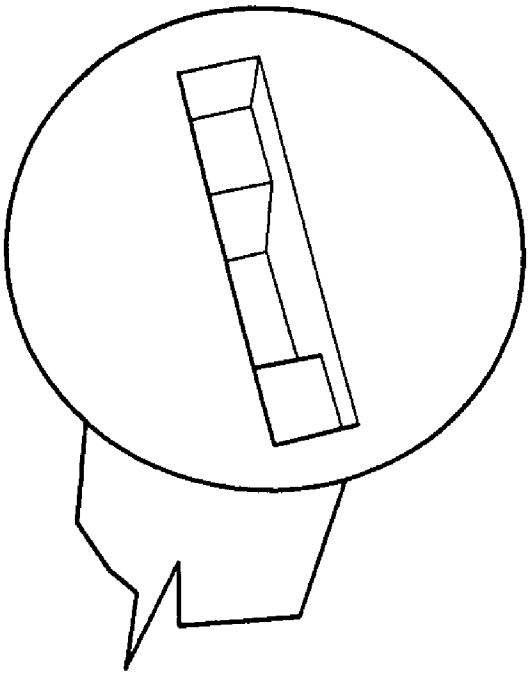
FIG. 10 is a perspective view showing an embodiment of a screw head.

Additional embodiments of screw 300 are contemplated and, with principal reference to FIGS. 10 and 11, slot 330 need not extend all the way to the circumference of head 320. A left band of material is shown to the left of slot 330 and a right band of material to the right of slot 330. One characteristic of this preferred embodiment and other embodiments is that the length of the slot is less than the diameter. This arrangement facilitates further engagement between flare drive 220 and slot 330. The full female structure of slot 330 facilitate even more secure mating between flare drive 220 and slot 330, thereby further decreasing slippage and increasing efficiency.

Although there has been hereinabove described a tool element and screw for mating engagement therewith, in accordance with the present invention, for the purposes of illustrating the manner in which the invention may be used to advantage, it should be appreciated that the invention is not limited thereto. Accordingly, any and all modifications, variations, or equivalent arrangements that may occur to one skilled in the art should be considered to be within the scope of the present invention as defined in the appended claims.

What is claimed is:

1. A fastening system comprising:

a tool element for facilitating driving of a screw comprising a blade, comprising a blade front surface, a blade rear surface, a blade left surface and a blade right surface;

a flared drive, a top end of the flared drive being fixed to a bottom end of the blade, and the flared drive comprising:

a flared drive bottom end;

a flared drive front surface, the flared drive front surface being coplanar with the blade front surface and extending from the blade front surface to the flared drive bottom end;

a flared drive rear surface, the flared drive rear surface being coplanar with the blade rear surface, extending from the blade rear surface to the flared drive bottom end and being parallel with the flared drive front surface;

a flared drive left surface outwardly extending from the blade left surface to the flared drive bottom end to form a first angle; and a flared drive right surface outwardly extending from the blade right surface to the flared drive bottom end to form a second angle; and a substantially rectangular shank drive, a top end of the substantially rectangular shank drive being fixed to the flared drive bottom end, and the substantially rectangular shank drive comprising:

a shank drive bottom surface;

a shank drive left surface;

a shank drive right surface being parallel with the shank drive left surface;

a shank drive front surface, the shank drive front surface being coplanar with the flared drive front surface;

a shank drive rear surface, the shank drive rear surface being coplanar with the flared drive rear surface and being parallel with the shank drive front surface;

a screw having a body and a head, the head comprising:

a slot aligned along an axis aligned with a diameter of the head and comprising:

a slot front inner surface; and a slot rear inner surface;

a substantially rectangular shank set formed below the slot, aligned along the axis and comprising;

a shank set front inner surface coplanar with the slot front inner surface; and a shank set rear inner surface coplanar with the slot rear inner surface; and the tool non-fixably engaging the screw so that the shank drive of the tool is inserted into the shank set of the screw and the flared drive of the tool rests in the slot of the screw.

2. The fastening system of claim 1, wherein a width of the shank drive front surface is less than a width of the flared drive front surface at the flared drive bottom end.

3. The fastening system of claim 1, wherein a width of the shank drive front surface is greater than a width of the shank drive right surface.

4. The fastening system of claim 1, wherein the shank drive front surface, shank drive rear surface, shank drive left surface, shank drive right surface and the shank drive bottom surface form substantially ninety-degree corners.

5. The fastening system of claim 1, wherein the shank drive front surface, shank drive rear surface, shank drive left surface, shank drive right surface and the shank drive bottom surface form radial corners.

6. The fastening system of claim 1, wherein the first angle is substantially equal to the second angle.

7. The fasting system of claim 1, wherein the first angle and the second angle are each acute angles with respect to the flared drive bottom end.

8. The fastening system of claim 1, wherein the blade, the flared drive and the substantially rectangular shank drive form a one-piece structure.

9. The fastening system of claim 1, wherein a screwdriver comprises the tool element.

10. The fastening system of claim 1, wherein screwdriver of claim 9, comprises:

a handle; and a shank connecting the handle to the blade;

wherein at least the shank, the blade, the flared drive and the substantially rectangular shank drive form a one-piece structure.

11. The fastening system of claim 1, wherein a tool bit comprises the tool element of claim 1.

12. The fastening system of claim 1, wherein an electrically powered tool comprises the tool bit of claim 11.

13. The fastening system of claim 12, wherein the electrically powered tool is comprised of:

electrically powered drive means;

a shaft connecting the electrically powered drive means to the tool bit, the shaft being axially rotatable by the electrically powered drive means; and a handle for positioning the electrically powered tool.

14. The fastening system of claim 1, wherein a ratchet comprises the tool element of claim 1.

15. The fastening system of claim 1, wherein the tool element of claim 1 is comprised of:

blade means; flared drive means fixed to the blade means, the flared drive means comprising a flared drive means front surface and a flared drive means rear surface; and substantially rectangular shank drive means fixed to the flared drive means, the substantially rectangular shank drive means comprising:

a shank drive means front surface, the shank drive means front surface being coplanar with the flared drive means front surface; and a shank drive means rear surface, the shank drive means rear surface being coplanar with the flared drive means rear surface.

16. The fastening system of claim 15, wherein a width of the shank drive means front surface is less than a width of the flared drive front surface at the bottom end of the flared drive means.

17. The fastening system of claim 15, wherein a width of the shank drive means front surface is greater than a width of a shank drive means right surface.

18. The fastening system of claim 15, wherein the shank drive means front surface, the shank drive means rear surface, a shank drive means left surface, a shank drive means right surface and a shank drive means bottom surface form substantially ninety-degree corners.

19. The fastening system of claim 15, wherein the shank drive means front surface, shank drive means rear surface, shank drive means left surface, shank drive means right surface and the shank drive means bottom surface form radial corners.

20. The fastening system of claim 15, wherein the flared drive means comprises:

a flared drive means left surface outwardly extending from a blade means left surface to a flared drive means bottom end to form a first angle; and a flared drive means right surface outwardly extending from a blade means right surface to the flared drive means bottom end to form a second angle substantially equal to the first angle.

21. The fastening system of claim 20, wherein the first angle and the second angle are each acute angles with respect to the flared drive means bottom end.

22. The fastening system of claim 1, wherein the blade means, the flared drive means and the substantially rectangular shank drive means form a one-piece structure.

23. The fastening system of claim 15, wherein a screwdriver comprises the tool element.

24. The fastening system of claim 23, wherein the screwdriver is comprised of:

a handle; and a shank connecting the handle to the blade means; and wherein at least the shank, the blade means, the flared drive means and the substantially rectangular shank drive means form a one-piece structure.

25. The fastening system of claim 15, wherein a tool bit comprises the tool element.

26. The fastening system of claim 25, wherein an electrically powered tool comprises the tool bit.

27. The fastening system of claim 26, where in the electrically powered tool is comprised of:

electrically powered drive means;

a shaft connecting the electrically powered drive means to the tool bit, the shaft being axially rotatable by the electrically powered drive means; and a handle for positioning the electrically powered tool.

28. The fastening system of claim 15, wherein a ratchet comprises the tool element.

29. The fastening system of claim 1, wherein the screw is further comprised of:

a left band of material to the left of the slot; and a right band of material to the right of the slot.

30. The fastening system of claim 29, wherein a length of the slot is less than the diameter.

31. The fastening system of claim 30, wherein the width of the shank set rear inner surface is greater than a width of the shank set left inner surface.

* * * * *